US012114818B2

(12) United States Patent
Eugene

(10) Patent No.: US 12,114,818 B2
(45) Date of Patent: Oct. 15, 2024

(54) RETRACTABLE WALL MOUNTED STORAGE CADDY

(71) Applicant: Fritz Gerard Eugene, New York City, NY (US)

(72) Inventor: Fritz Gerard Eugene, New York City, NY (US)

( * ) Notice: Subject to any disclaimer, the term of this patent is extended or adjusted under 35 U.S.C. 154(b) by 0 days.

(21) Appl. No.: 17/577,334

(22) Filed: Jan. 17, 2022

(65) Prior Publication Data

US 2022/0225843 A1 Jul. 21, 2022

Related U.S. Application Data

(60) Provisional application No. 63/140,194, filed on Jan. 21, 2021.

(51) Int. Cl.

| | |
|---|---|
| ***A47B 51/00*** | (2006.01) |
| ***A47B 53/00*** | (2006.01) |
| ***A47K 3/28*** | (2006.01) |
| ***A47K 5/04*** | (2006.01) |

(52) U.S. Cl.

CPC ..... *A47K 3/281* (2013.01); *A47B 51/00* (2013.01); *A47B 53/00* (2013.01); *A47K 5/04* (2013.01)

(58) Field of Classification Search

CPC ... A47K 3/281; A47K 5/04; A47F 2005/0075; A47B 53/00; A47B 53/02; A47B 2051/005; A47B 46/00; A47B 51/00; A47B 61/00; A47B 61/06; A47B 69/00; A47B 77/00; A47B 77/04

USPC ..... 211/119.009, 119.011, 175, 2, 1.3, 1.57, 211/88.02; 312/246–248, 277, 272, 272.5

See application file for complete search history.

(56) References Cited

U.S. PATENT DOCUMENTS

| | | | | | |
|---|---|---|---|---|---|
| 926,946 | A * | 7/1909 | Klug | A47B 81/067 | 312/328 |
| 964,242 | A * | 7/1910 | Greenwalt | A47B 81/067 | 312/271 |
| 1,893,526 | A * | 1/1933 | Shriver | B25H 3/023 | 190/18 R |
| 2,227,342 | A * | 12/1940 | Gustowski | A45D 44/18 | 312/226 |
| 2,614,020 | A * | 10/1952 | Collins | A47B 51/00 | 312/312 |
| 2,796,310 | A * | 6/1957 | Anderson | B60R 7/06 | 312/246 |
| 3,027,215 | A * | 3/1962 | Duncan | G01G 19/44 | 16/221 |
| 3,552,529 | A * | 1/1971 | Marshall | A47B 61/06 | 190/107 |
| 4,003,610 | A * | 1/1977 | Main | H02B 1/50 | 312/324 |
| 4,150,861 | A * | 4/1979 | Dufrancatel | A47B 46/005 | 312/271 |

(Continued)

*Primary Examiner* — Jennifer E. Novosad

(57) ABSTRACT

A retractable wall mounted storage system comprising at least one lever and a method for conveying rotational energy in a retractable manner. A plurality of storage compartments, which are in a predetermined retractable configuration. The retractable storage system is capable of opening and closing vertically, whereby simultaneously revealing stored items within. Optionally, depending upon user preference, the retractable storage system is equipped with a plurality of changeable front theme panels that provide an unparalleled option for personalization.

20 Claims, 10 Drawing Sheets

(56) References Cited

U.S. PATENT DOCUMENTS 4,285,557 A * 8/1981 Paladino ..... G11B 23/0236 220/519
4,485,928 A * 12/1984 Staashelm ..... A47B 46/00 312/246
4,541,131 A * 9/1985 Sussman ..... A47K 3/001 4/596
4,662,690 A * 5/1987 Genereaux ..... A47B 88/48 312/274
4,766,881 A * 8/1988 Pax ..... F24C 15/20 126/299 R
4,915,461 A * 4/1990 Kingsborough ..... A47B 77/10 312/247
5,494,178 A * 2/1996 Maharg ..... A47F 5/0815 52/509
5,758,782 A * 6/1998 Rupert ..... A47B 46/00 211/104
5,857,756 A * 1/1999 Fehre ..... A47B 46/005 312/246
5,946,838 A * 9/1999 Lanoue ..... G09F 7/18 211/113
6,484,893 B1 * 11/2002 Tkatch ..... A47F 3/063 211/94.01
6,578,938 B2 * 6/2003 Norman ..... A47B 43/00 312/262
6,880,708 B2 * 4/2005 Boron ..... A47F 1/12 211/74
7,770,986 B1 * 8/2010 Simaitis ..... A47B 46/005 312/246
7,922,268 B2 * 4/2011 Weber ..... A47B 46/005 312/246
7,963,533 B2 * 6/2011 Bothun ..... A47F 5/108 280/47.35
8,414,093 B2 * 4/2013 Moran ..... A47B 51/00 312/246
8,424,983 B1 * 4/2013 Strauss ..... A47B 51/00 312/247
8,556,355 B2 * 10/2013 Greenberg ..... A47B 51/00 312/271
8,616,383 B1 * 12/2013 Miller ..... B68C 1/002 211/1.51
8,622,488 B1 * 1/2014 Kilby ..... A47B 96/06 211/202
8,641,156 B2 * 2/2014 Chow ..... A47B 51/00 312/247
8,763,822 B2 * 7/2014 Didehvar ..... A47B 45/00 211/175
8,777,338 B2 * 7/2014 Bunch ..... A47B 51/00 312/248
8,813,916 B2 * 8/2014 Schilling ..... H05K 5/0213 312/22
8,955,648 B1 * 2/2015 Weller ..... B66B 9/00 254/338
8,991,948 B2 * 3/2015 Marsters ..... A47B 46/005 312/301
9,044,106 B1 * 6/2015 Smith ..... G06K 9/6217
9,055,813 B2 * 6/2015 Telthorster ..... A47B 51/00
9,872,561 B1 * 1/2018 Alfaro ..... A47B 88/402
10,350,748 B2 * 7/2019 Michael ..... B25H 3/04
10,561,235 B1 * 2/2020 Abbott ..... A47B 77/10
10,889,970 B2 * 1/2021 Son ..... A47J 47/20
10,973,319 B2 * 4/2021 Eames ..... A47G 25/0692
2004/0211737 A1 * 10/2004 Siegel ..... A47G 21/14 248/37.3
2007/0236114 A1 * 10/2007 Fuentes ..... A47B 46/005 312/246
2011/0266936 A1 * 11/2011 Moran ..... A47B 51/00 211/1.57
2014/0124468 A1 * 5/2014 Lundrigan ..... A47B 47/027 211/182
2014/0175962 A1 * 6/2014 Hollenstein ..... A47B 51/00 312/319.5
2014/0197720 A1 * 7/2014 Sorbara ..... A47B 51/00 312/247
2014/0203692 A1 * 7/2014 Marsters ..... A47B 46/005 312/246
2014/0217861 A1 * 8/2014 Cole ..... A47B 45/00 312/205
2014/0252930 A1 * 9/2014 Reid ..... A47B 46/005 312/247
2015/0145393 A1 * 5/2015 Young ..... A47B 46/005 312/246
2016/0166058 A1 * 6/2016 Bunch ..... A47B 77/10 312/249.7
2017/0341924 A1 * 11/2017 DeWitt ..... B60P 7/0815
2020/0277770 A1 * 9/2020 Hong ..... A47B 77/022
2022/0167740 A1 * 6/2022 Sharma ..... A47B 51/00
2022/0183460 A1 * 6/2022 Aghaei ..... A47B 51/00
2022/0211220 A1 * 7/2022 Lavery ..... A47K 3/281
2022/0225843 A1 * 7/2022 Eugene ..... A47K 3/281

* cited by examiner

RETRACTABLE WALL MOUNTED STORAGE CADDY

CLAIM OF PRIORITY

This application claims priority to U.S. Provisional Patent Application No. 63/140,194, filed Jan. 21, 2021, entitled "SHOWER/BATH CADDY", the contents of which are hereby incorporated by reference, in their entirety.

NOTICE OF COPYRIGHTS AND TRADE DRESS

A portion of the disclosure of this patent document contains material which is subject to copyright or trade dress protection. This patent document may show and/or describe matter that is or may become trade dress of the owner. The copyright and trade dress owner has no objection to the facsimile reproduction by anyone of the patent disclosure, as it appears in the Patent and Trademark Office patent files or records, but otherwise reserves all copyright and trade dress rights whatsoever.

FIELD OF THE EMBODIMENTS

The present disclosure relates generally to a retractable storage caddy with changeable front theme panel more particularly, the present disclosure relates to a wall mounted retractable storage system that enables a user to conceal products retractably in a housing that reflects the user's preference for art, sport, and abstract forms and colors.

BACKGROUND

I have found that despite the wide availability of storage products/caddies, a need for a unique alternative solution that enrich our daily lives is always welcome. The present invention and its embodiments provide a method to elegantly and artistically conceal and store a plurality of products.

Further, similar storage products/caddies fail to offer an option for personalization.

Lastly, self care is very popular today and many people are looking for products that contribute to their well being. Accordingly, there is a need for unique storage options capable of changing their appearance depending on user preference.

It is an object of the present invention to provide a means to diverge from traditional storage caddies/system to a more personalized product and method of concealing everyday items.

The present invention and its embodiment meets and exceeds this objective.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

SUMMARY

Briefly described, one embodiment among others, relates generally to a retractable storage system. More particularly, this invention relates to (here called) "A wall mounted retractable storage caddy with changeable front theme panel".

One of the objectives of this embodiment is to create better options for artistically concealing your preferred products in a retractable housing.

Still another object of this embodiment is to provide the user the freedom and ability to morph/change the front theme panel in a plurality of shapes, sizes, textures and colors.

The present embodiment can be used as a storage organizer/caddy in any suitable situation, including in showers.

Showers in particular are littered with shower essentials. Bottles, soaps, razors, all laid out in the open. This embodiment solves these issues in a manner which conceals a plurality of products in a retractable storage housing/system.

Furthermore, the front theme panel is capable of having a finish in tile, wood, glass, plastic, leather, metal, crystal, ceramics and the like, and take on a plurality of different forms.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE PREFERRED EMBODIMENTS

In the drawings, like elements are depicted by like reference numerals. The drawings are briefly described as follows.

The present disclosure now will be described more full hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete, and fully conveys the scope of the present disclosure to those skilled in the art. In fact, it will be apparent to those skilled in the art that various modifications and variations can be made in the present invention without departing from the scope or spirit of the invention.

PARTS DESCRIPTION

FIG. 1

100—Main Core
101—Rear Mounting Panel
102—Rotational Core Wheel
104—Core Lever
106—Reverse Motion Linkage
108—Reverse Motion Linkage
110—Upper Slider Piston
112—Lower Slider Piston
114—Upper Slider
116—Lower Slider
118—Upper Slider Basket
120—Lower Slider Basket
122—Anchor Point

FIG. 2

202—Core Lever
203—Lever Passageway
204—Right Side Panel
206—Left Side Panel
208—Top Lid Panel

FIG. 3

302, 304, 306, 308—Mounting Insert Holes

FIG. 5

500—Top Lid Opening Member
502, 504, 506—Stabilizing Member

FIG. 7

600—Upper Front Theme Panel
602—Lower Front Theme Panel

DETAILED DESCRIPTION OF THE PREFERRED EMBODIMENTS

Figure 1:
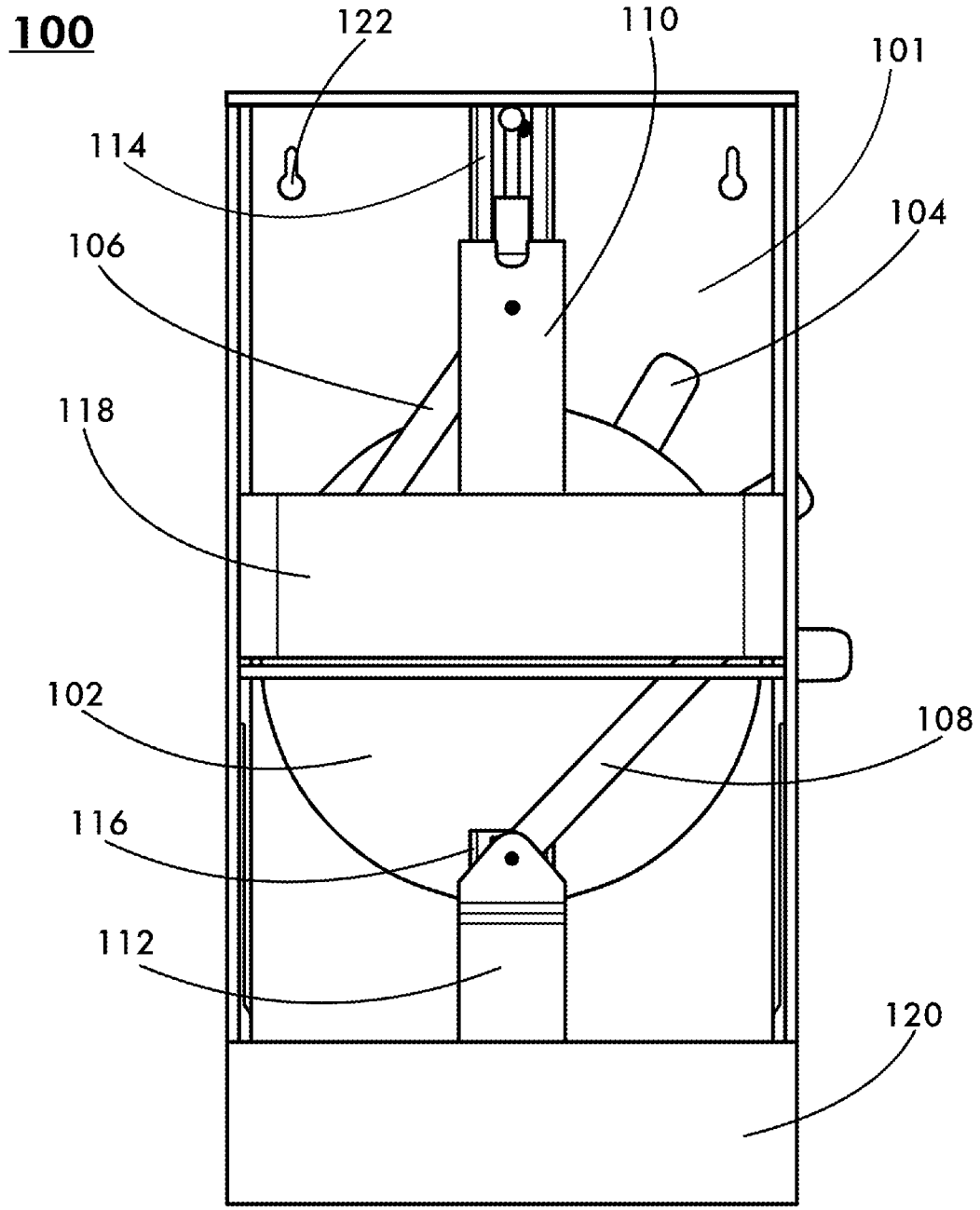
FIG. 1 is a front view of an embodiment of a retractable storage caddy in the closed position.

FIG. 1 Illustrates an embodiment of a retractable wall mounted storage caddy 100 in accordance with the present disclosure. The retractable wall mounted storage caddy 100 has a housing, with a rear mounting panel 101, which has a rotational core wheel 102 pivotally attached to the rear mounting panel 101. The core wheel 102 has a plurality of levers 104, which actuate the vertical motion of the retractable wall mounted storage caddy.

FIG. 1 Also shows that the rotational core wheel 102 is pivotally attached to a plurality of reverse motion linkage 106, 108 which in this embodiment actuate an upper slider piston 110 and a lower slider piston 112 simultaneously allowing in this embodiment, retractable access to a plurality of products.

FIG. 1 Further in this embodiment illustrates that the upper slider piston 110, and the lower slider piston 112 are connected to a plurality of slider baskets 118, 120 which utilize the vertical placement of an upper slider 114 and a lower slider 116.

Figure 2:
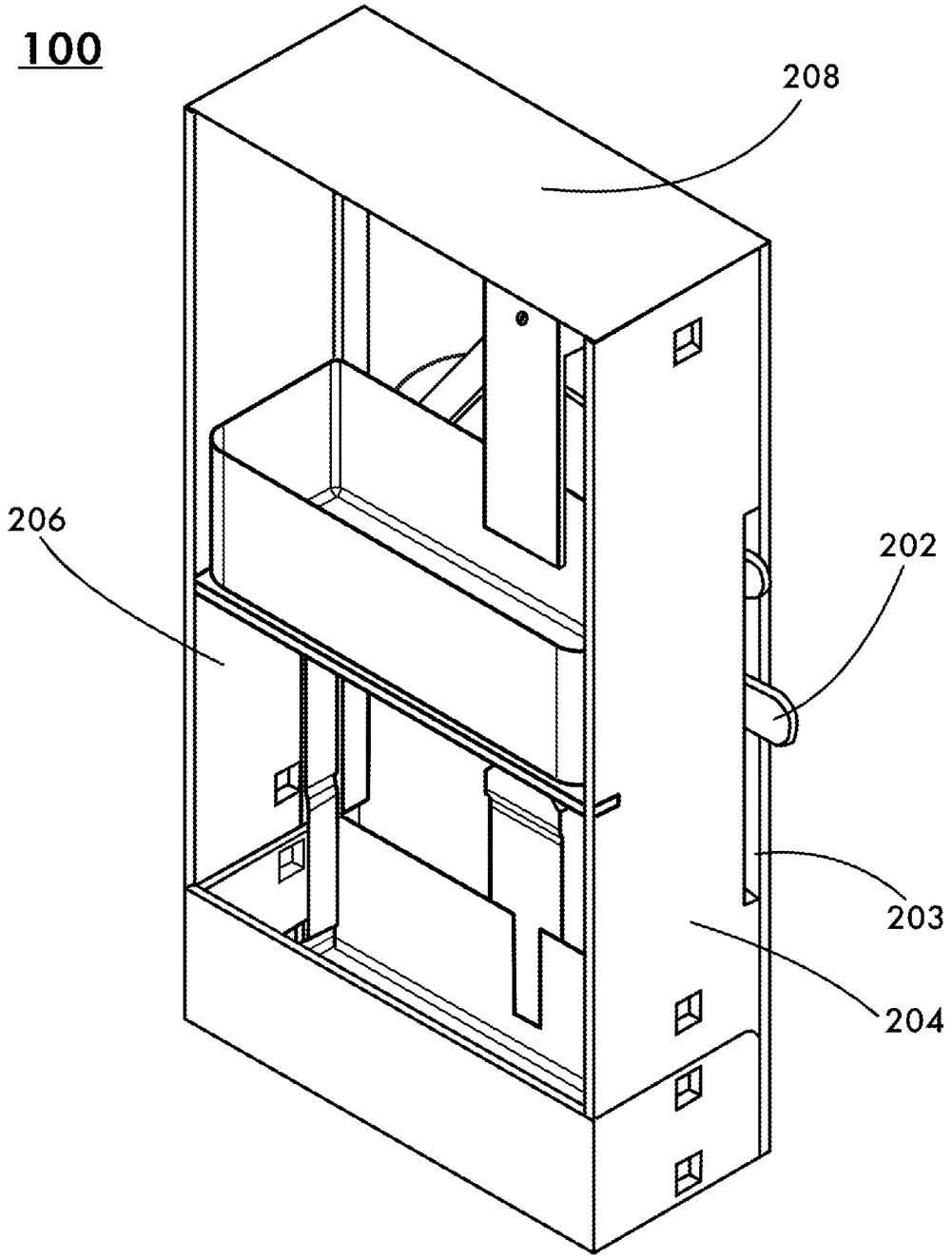
FIG. 2 is a perspective front view of an embodiment of a retractable storage caddy in the closed position.

Referring to FIG. 2, a perspective front view of an embodiment of a retractable wall mounted storage caddy. 100 is shown here having a left side 206 and a right side 204 and a top 208 which is hinged and capable of opening and closing. Also having one of a plurality of levers 202 that actuate vertical motion.

As can be seen the retractable wall mounted storage caddy has a passage 203 that facilitates the rotational motion of a plurality of levers 202.

Figure 3:
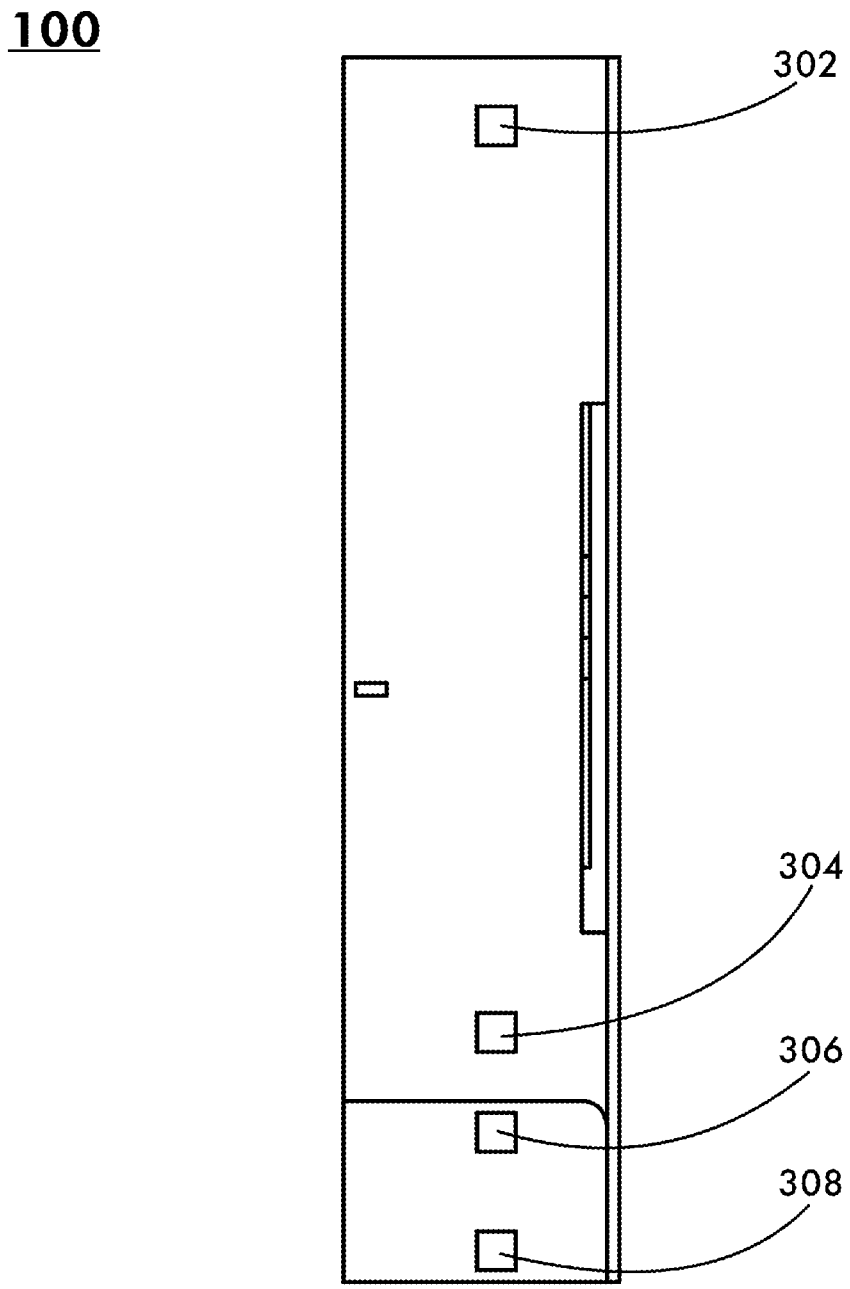
FIG. 3 is a side view of an embodiment of a retractable storage caddy in the closed position.

Referring to FIG. 3, a right side view of a retractable wall mounted storage caddy 100 in the closed position in this embodiment. As shown, there are female insert holes 302, 304, 306, 308, which are also found on the left side, for attaching a front theme panel FIG. 6, which can take on a plurality of forms, shapes, sizes and colors.

Figure 4:
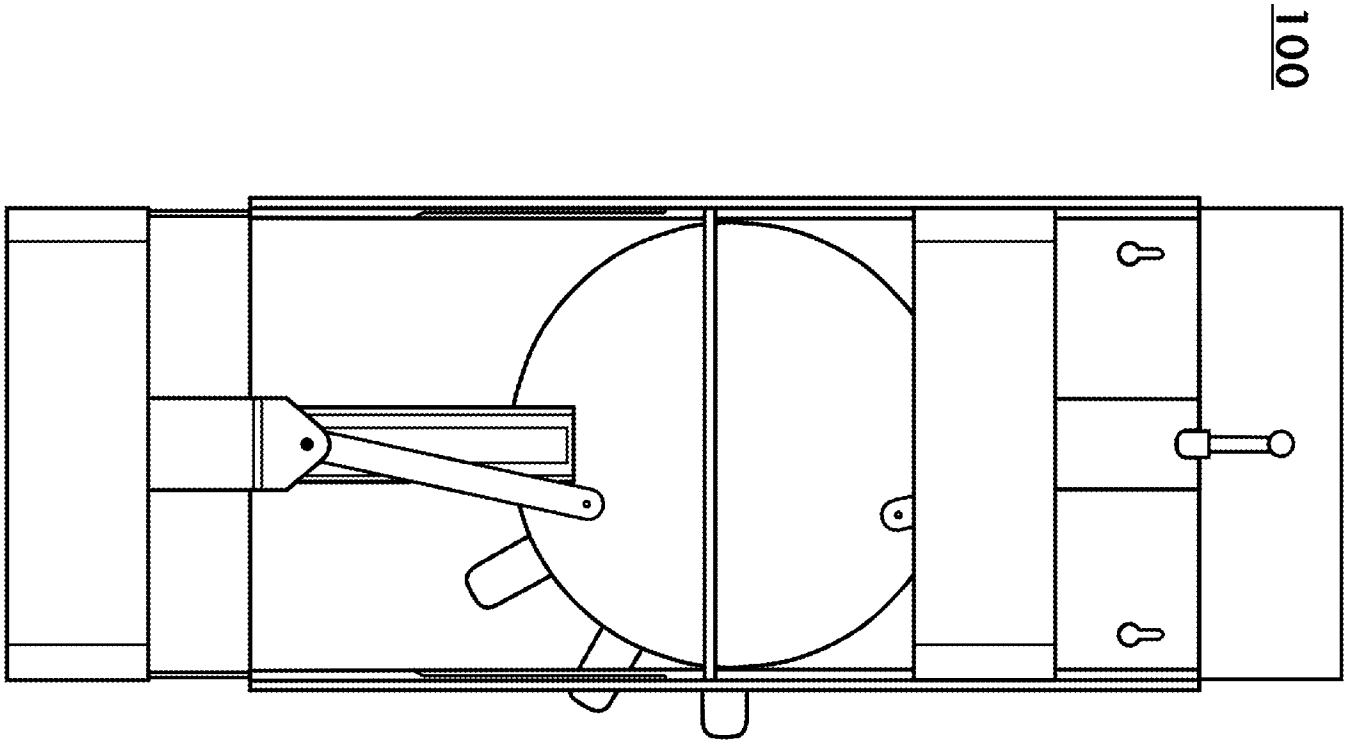
FIG. 4 is a front view of an embodiment of a retractable storage caddy in the open position.

Referring to FIG. 4, a front view of an embodiment of a retractable wall mounted storage caddy 100 illustrating the individual storage units above and below in the open position, whereby the user can access stored products.

Figure 5:
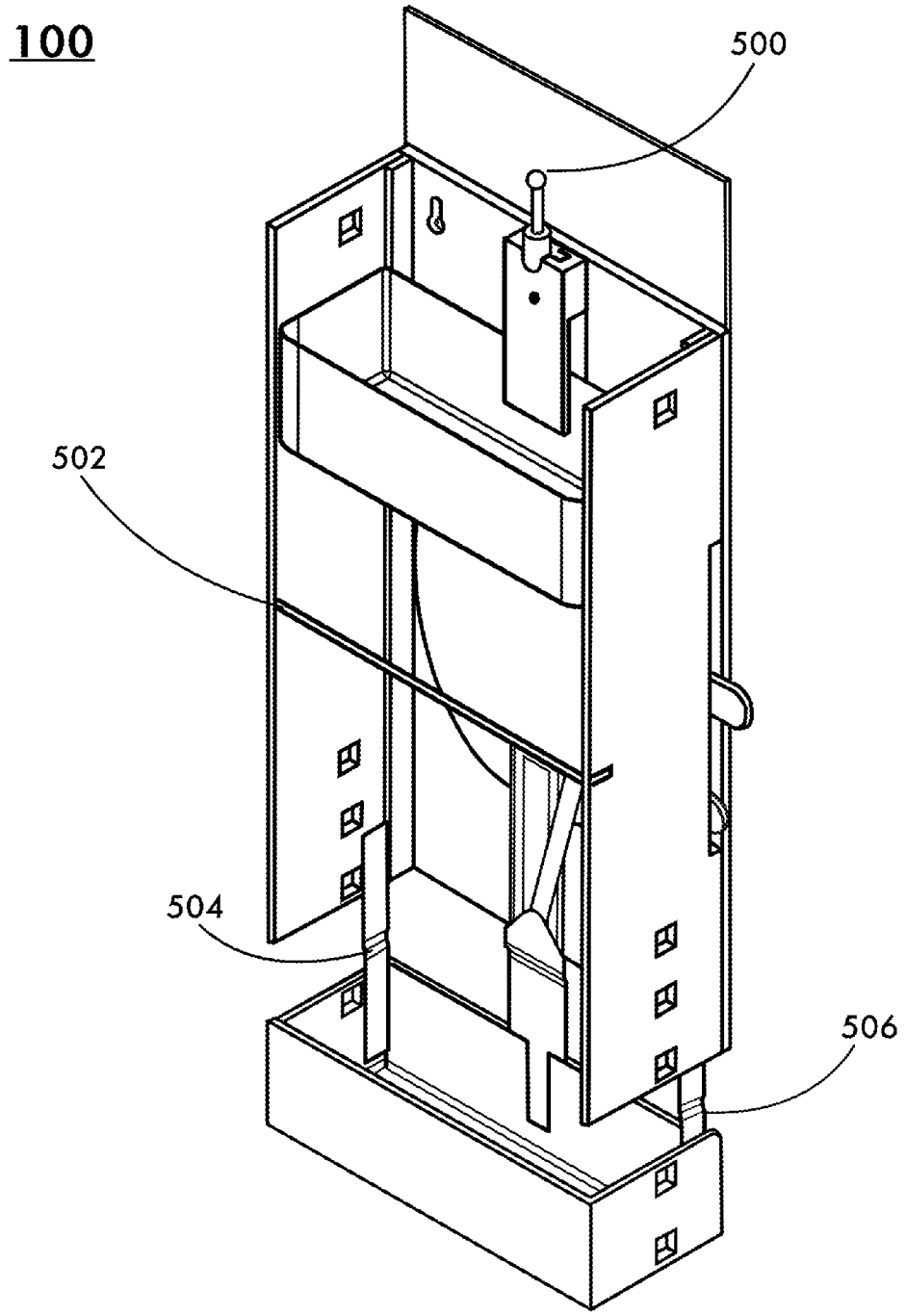
FIG. 5 is a perspective front view of an embodiment of a retractable storage caddy in the open position.

Referring to FIG. 5, a perspective front view of an embodiment of a retractable wall mounted storage caddy in the open position as shown having a top lid opening member 500, which is mounted in this embodiment to the upper slider piston 110. In addition as shown in accordance with the present embodiment, are a plurality of stabilizing members 502, 504, 506.

Figure 6:
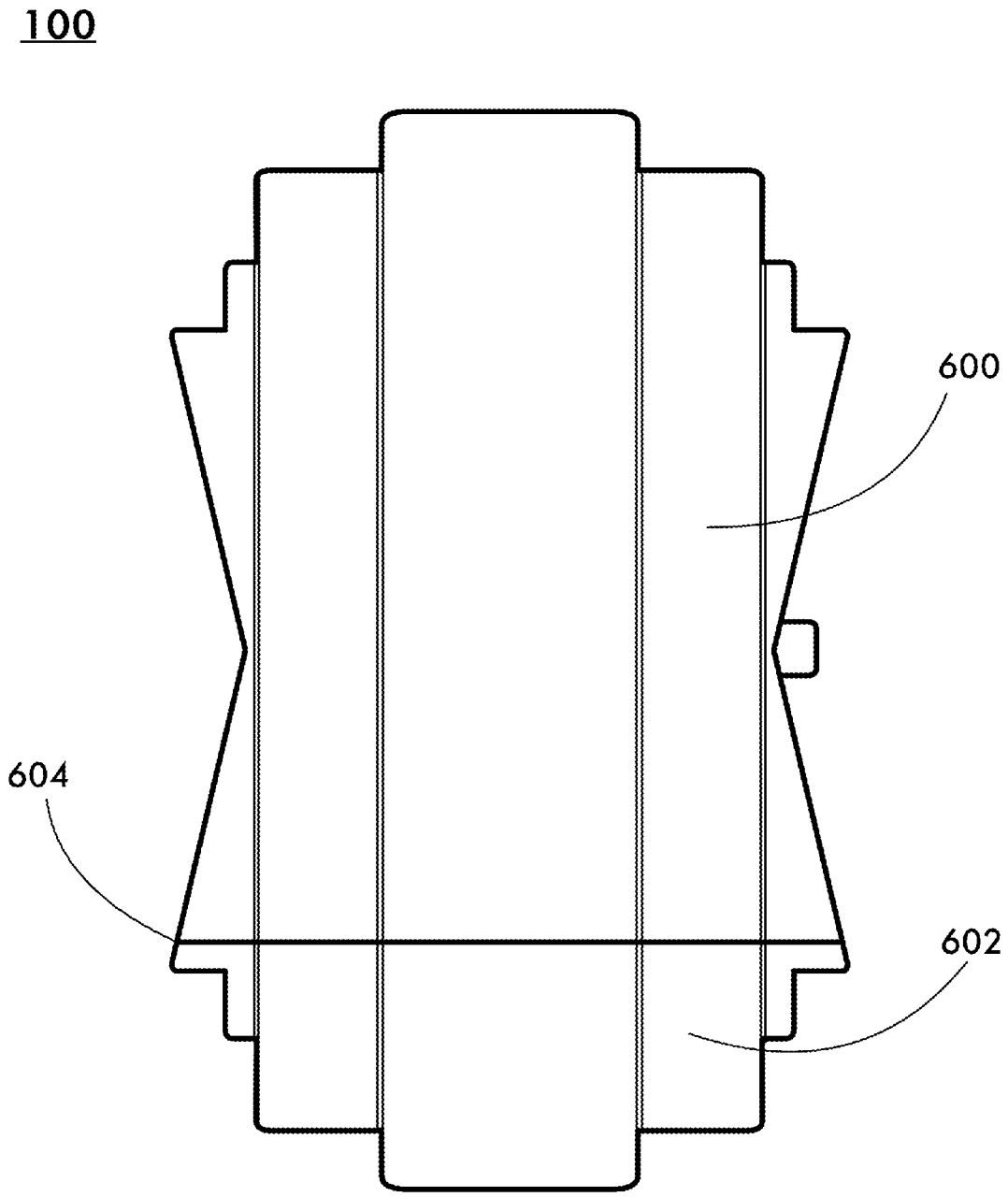
FIG. 6 is a front view of an embodiment of a retractable storage caddy with a front theme panel in the closed position.

Referring to FIG. 6, in accordance with some embodiments, a front theme display in the closed position has an upper front theme 600, a lower portion 602, which may be easily detached and replaced with an alternative front theme display. A point of separation 604 that facilitates the vertical separation of the desired front theme and allows access to a plurality of products within the main core 100.

Figure 7:
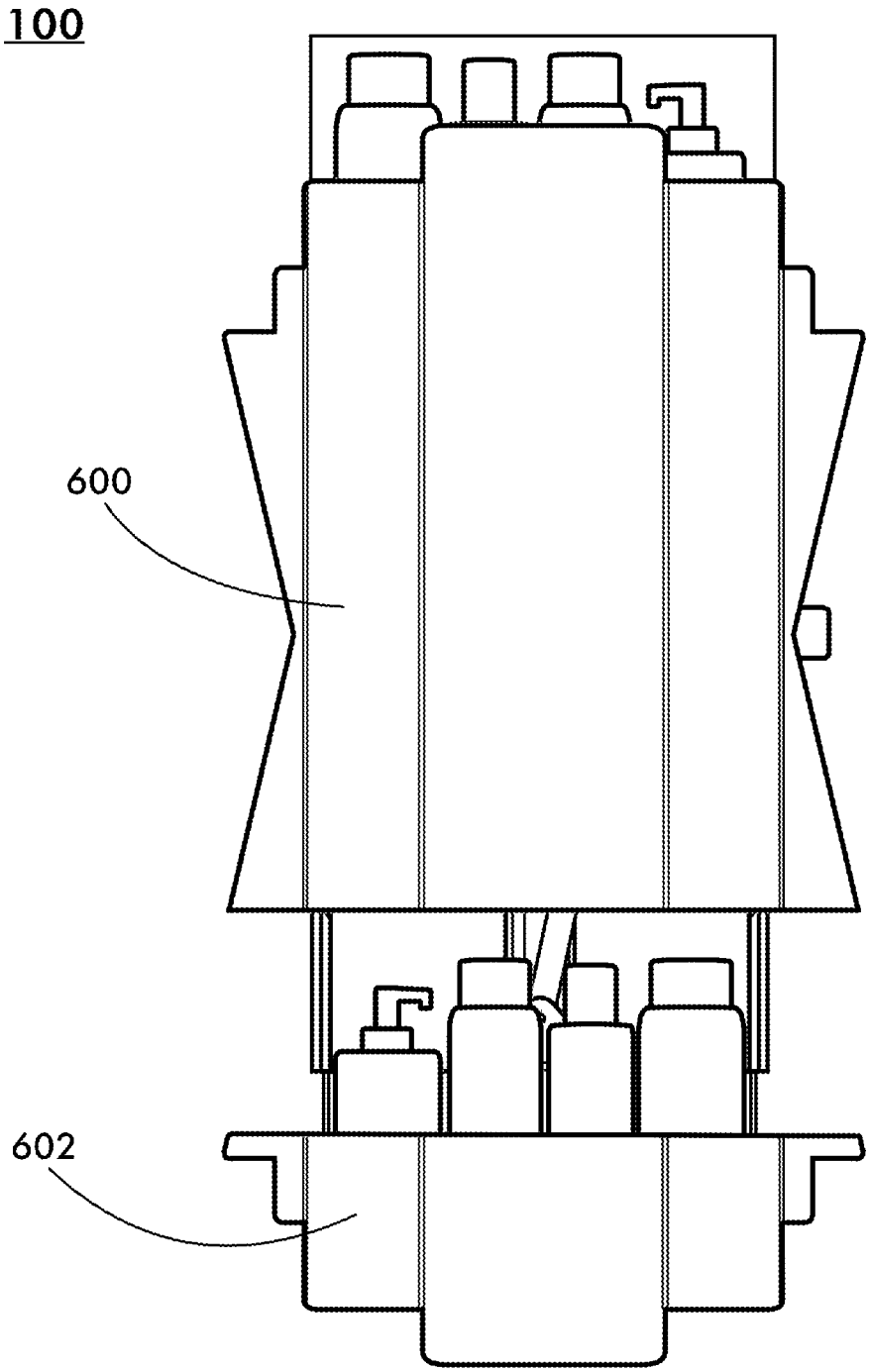
FIG. 7 is a front view of an embodiment of a retractable storage caddy with a front theme panel in the open position.

Referring to FIG. 7, a retractable wall mounted storage caddy with changeable front theme panel/display in the open position.

Figure 8:
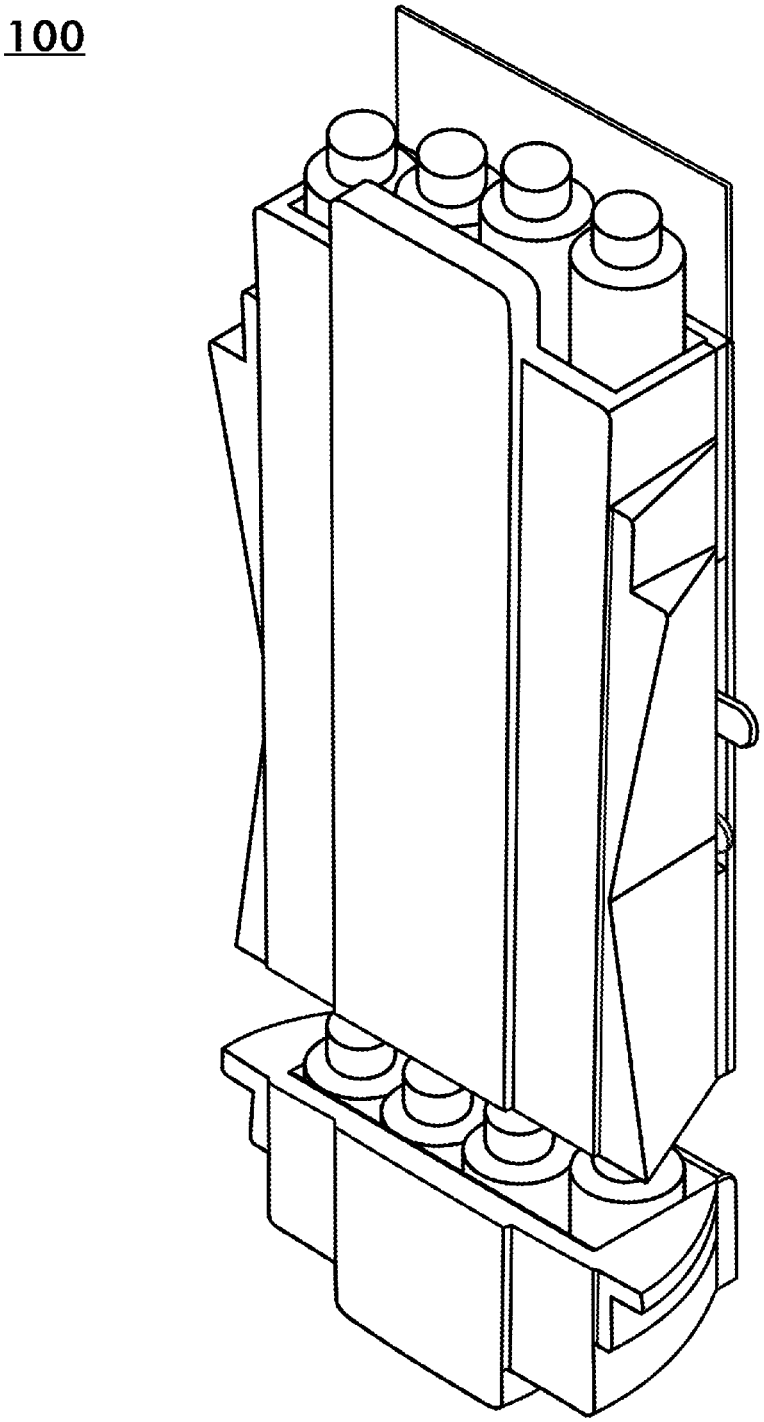
FIG. 8 is a perspective front view of an embodiment of a retractable storage caddy with a front theme panel in the open position.

Referring to FIG. 8, a perspective front view of a retractable wall mounted storage caddy with changeable front theme panel/display in the open position.

Figure 9:
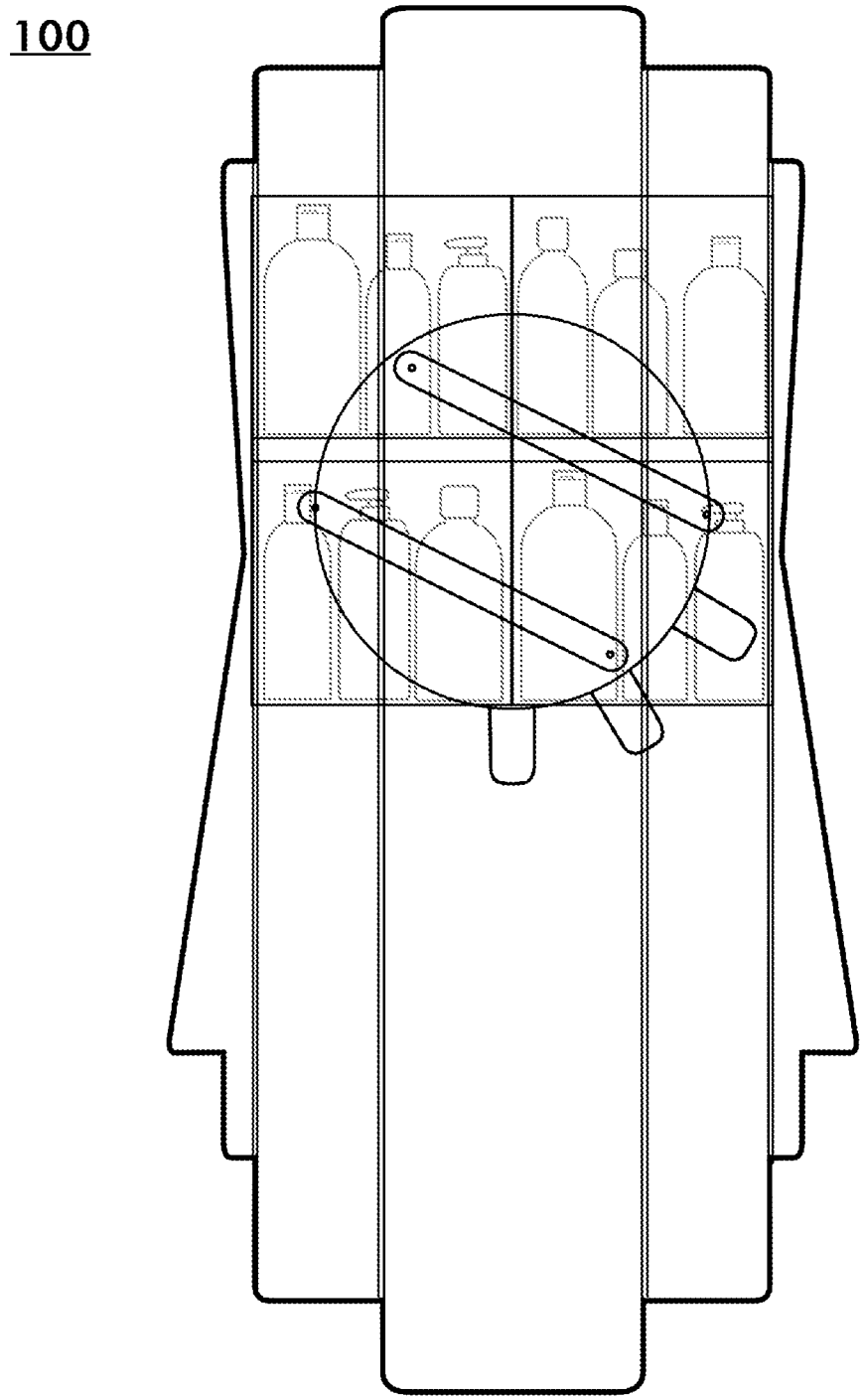
FIG. 9 is a front view of an alternative embodiment of a retractable storage caddy with a front theme panel and a horizontal opening and closing mechanic in the closed position.

Referring to FIG. 9, an alternative embodiment of a retractable wall mounted storage caddy with changeable front theme panel/display in the closed position, whereas the core storage housing has a horizontal opening configuration.

Figure 10:
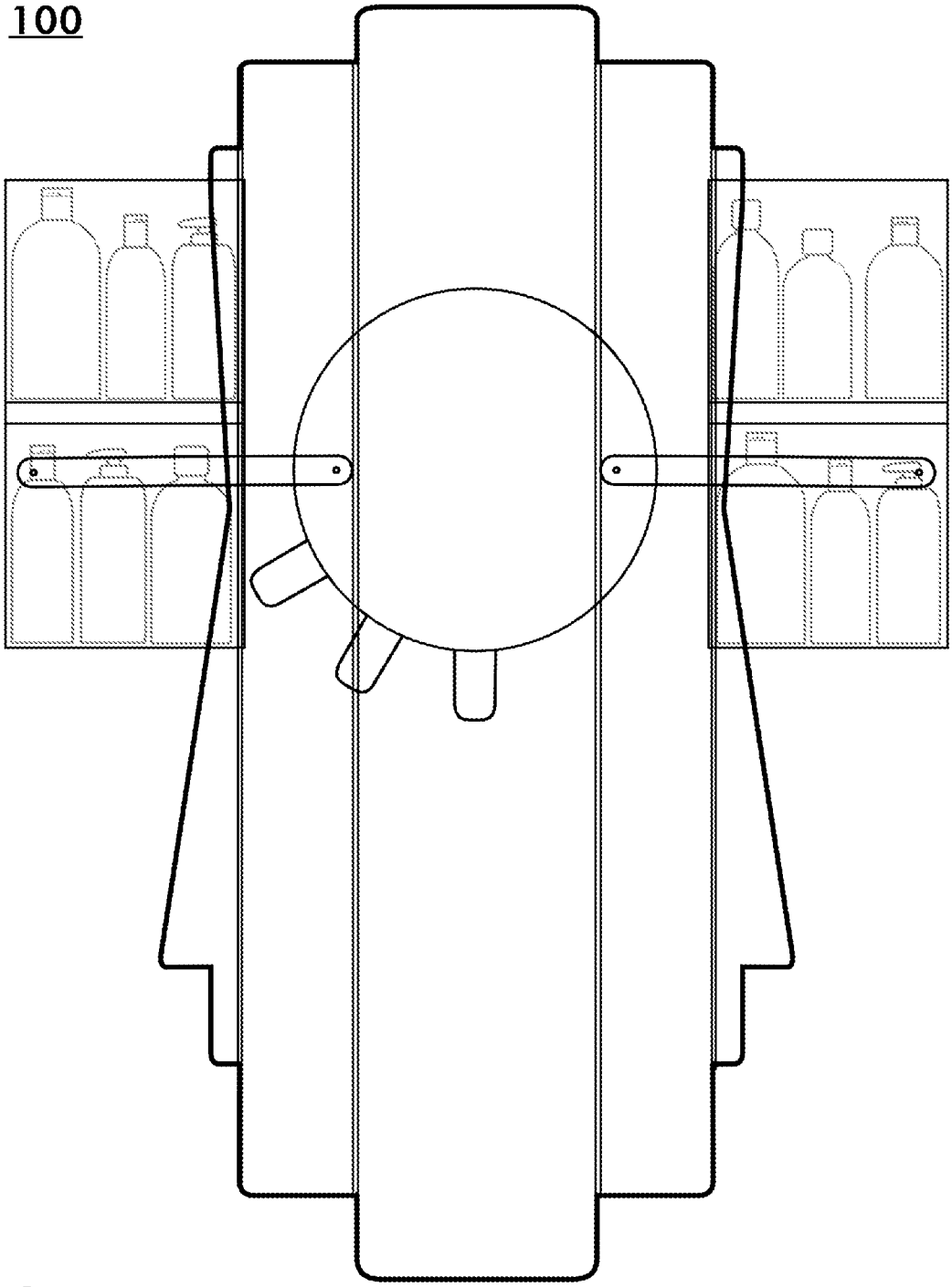
FIG. 10 is a front view of an alternative embodiment of a retractable storage caddy with a front theme panel and a horizontal opening and closing mechanic in the open position.

Referring to FIG. 10, an alternative embodiment of a retractable wall mounted storage caddy with changeable front theme panel/display in the open position, whereas the core storage housing has a horizontal opening configuration.

It is understood that any components or materials can be formed from a same, structurally continuous piece or separately fabricated and connected.

It is further understood that, although ordinal terms, such as, "first," "second," and "third," are used herein to describe various elements, components, regions, layers and/or sections, these elements, components, regions, layers and/or sections should not be limited by these terms. These terms are only used to distinguish one element, component, region, layer and/or section from another element, component, region, layer and/or section. Thus, a "first element," "component," "region," "layer" and/or "section" discussed below could be termed a second element, component, region, layer and/or section without departing from the teachings herein.

Features illustrated or described as part of one embodiment can be used with another embodiment and such variations come within the scope of the appended claims and their equivalents.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to perspective illustrations that are schematic illustrations of idealized embodiments. As such, variations from the shapes of the illustrations, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As the invention has been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

In conclusion, herein is presented a retractable wall mounted storage caddy with changeable front theme panel and method of use. The disclosure is illustrated by example in the drawing figures, and throughout the written description. It should be understood that numerous variations are possible while adhering to the inventive concept. Such variations are contemplated as being a part of the present disclosure.

I claim:

1. A retractable storage caddy comprising:

a housing comprising:

a left side panel, a right side panel, a rear mounting panel, and a top lid panel, wherein:

a rotational core wheel is pivotally attached to the rear mounting panel, levers are attached to the rotational core wheel, reverse motion linkages are pivotally attached to the rotation core wheel, slider pistons are attached to the reverse motion linkages, and slider baskets are attached to the slider pistons, and wherein:

the levers are configured to rotate the rotational core wheel, the rotational core wheel is configured to actuate the reverse motion linkages, the reverse motion linkages are configured to move the slider pistons, and the slider pistons are configured to move the slider baskets, the housing further comprising:

an upper front theme panel, and a lower front theme panel.

2. The retractable storage caddy of claim 1, wherein the sliding pistons comprise a lower slider piston and an upper slider piston, and the lower slider piston and the upper slider piston are configured to move the slider baskets in a vertical motion.

3. The retractable storage caddy of claim 1, wherein the sliding pistons comprise a first slider piston and a second slider piston, and the first slider piston and the second slider piston are configured to move the slider baskets in a horizontal motion.

4. The retractable storage caddy of claim 1, wherein the rear mounting panel further comprises anchor points configured for wall mounting.

5. The retractable storage caddy of claim 1, wherein the housing is a wall mounted housing, and the upper front theme panel and the lower front theme panel are detachable.

6. The retractable storage caddy of claim 1, wherein the left side panel and right side panel comprise mounting insert holes configured for attaching the upper front theme panel and the lower front theme panel.

7. The retractable storage caddy of claim 1, further comprising a top lid opening member, wherein the top lid opening member is attached to an upper slider basket of the slider baskets and configured to open the top lid panel when the upper slider basket is moved in a horizontal motion.

8. The retractable storage caddy of claim 1, further comprising stabilizer members, wherein the stabilizer members are attached to a lower slider basket of the slider baskets.

9. The retractable storage caddy of claim 1, further comprising a stabilizer member, wherein the stabilizer member connects the left side panel and the right side panel.

10. The retractable storage caddy of claim 1, wherein the housing further comprises a lever passageway configured to allow for rotational movement of at least one of the levers and access to the at least one lever by a user.

11. The retractable storage caddy of claim 1, wherein the upper front theme panel and the lower front theme panel are detachable.

12. The retractable storage caddy of claim 11, wherein the upper front theme panel and the lower front theme panel are fabricated from tile, wood, glass, plastic, leather, metal, crystal, ceramic, and combinations thereof.

13. The retractable storage caddy of claim 11, wherein the upper front theme panel and the lower front theme panels have a color, texture, and finish selected by a user.

14. The retractable storage caddy of claim 11, wherein the upper front theme panel and the lower front theme panels have a size and shape selected by a user.

15. A method for concealing stored products in a housing and displaying the stored products, wherein:

the housing comprises:

a left side panel, a right side panel, a rear mounting panel, and a top lid panel, wherein:

a rotational core wheel is pivotally attached to the rear mounting panel, levers are attached to the rotational core wheel, reverse motion linkages are pivotally attached to the rotational core wheel, slider pistons are attached to the reverse motion linkages, and slider baskets are attached to the slider pistons, and wherein:

the levers are configured to rotate the rotational core wheel, the rotational core wheel is configured to actuate the reverse motion linkages, the reverse motion linkages are configured to move the slider pistons, and the slider pistons are configured to move the slider baskets.

16. The method of claim 15, wherein the housing is a wall mounted housing, and wherein the housing further comprises:

an upper front theme panel, and a lower front theme panel.

17. The method of claim 16, wherein the upper front theme panel and the lower front theme panel are detachable.

18. The method of claim 17, wherein the upper front theme panel and the lower front theme panel are prepared from tile, wood, glass, plastic, leather, metal, crystal, ceramic, and combinations thereof.

19. The method of claim 15, wherein the slider baskets are configured to move vertically.

20. The method of claim 15, wherein the slider baskets are configured to move horizontally.

* * * * *